US010550557B2

(12) United States Patent
Huber

(10) Patent No.: US 10,550,557 B2
(45) Date of Patent: Feb. 4, 2020

(54) TOILET PLUNGER AND WASTE FRACTURING ASSEMBLY

(71) Applicant: Jeff Huber, Stillwater, MN (US)

(72) Inventor: Jeff Huber, Stillwater, MN (US)

( * ) Notice: Subject to any disclaimer, the term of this patent is extended or adjusted under 35 U.S.C. 154(b) by 0 days.

(21) Appl. No.: 16/021,260

(22) Filed: Jun. 28, 2018

(65) Prior Publication Data

US 2019/0010687 A1 Jan. 10, 2019

Related U.S. Application Data

(60) Provisional application No. 62/529,011, filed on Jul. 6, 2017.

(51) Int. Cl.
*E03C 1/308* (2006.01)

(52) U.S. Cl.
CPC ..... *E03C 1/308* (2013.01)

(58) Field of Classification Search
CPC ..... E03C 1/308
USPC ..... 4/255.11, 255.07
See application file for complete search history.

(56) References Cited

U.S. PATENT DOCUMENTS 2,473,452 A * 6/1949 Scott ..... E03C 1/308 15/104.33
7,308,728 B2 * 12/2007 Haviv ..... A47K 11/10 4/255.11
2008/0250588 A1 * 10/2008 Robinson ..... E03C 1/308 15/104.05

* cited by examiner

*Primary Examiner* — Tuan N Nguyen

(57) ABSTRACT

A toilet plunger and waste fracturing assembly includes a tube that has a first end and a second end and a longitudinal axis extending between the first and second ends. A cup is attached to the second end and is comprised of a resiliently flexible material and is used to force fluid down a toilet drain. A rod is positioned in the tube, extends outwardly of the second end and through an aperture in the cup. The rod has an interior end positioned within the tube and an exterior end positioned outside of the tube. The tube has an elongated slot therein extending through and along a perimeter wall of the tube. A grip extends through the slot and is attached to the internal end of the rod. The grip is movable along the slot to move the internal end toward or away from the second end of the tube.

13 Claims, 10 Drawing Sheets

TOILET PLUNGER AND WASTE FRACTURING ASSEMBLY

CROSS-REFERENCE TO RELATED APPLICATIONS

I hereby claim the benefit under 35 U.S.C. Section 119(e) of U.S. Provisional application 62/529,011 filed on Jul. 6, 2017.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to toilet clog clearing devices and more particularly pertains to a new toilet clog clearing device for removing clogs from toilet drains by combining a plunger with a waste engaging spear.

BRIEF SUMMARY OF THE INVENTION

An embodiment of the disclosure meets the needs presented above by generally comprising a tube that has a first end and a second end. The tube has a longitudinal axis extending between the first and second ends. A cup is attached to the second end and is comprised of a resiliently flexible material and is used to force fluid down a toilet drain. A rod is positioned in the tube, extends outwardly of the second end and through an aperture in the cup. The rod has an interior end positioned within the tube and an exterior end positioned outside of the tube. The tube has an elongated slot therein extending through and along a perimeter wall of the tube. The slot extends along a line is parallel to the longitudinal axis. A grip is attached to the internal end of the rod. The grip is positioned in the slot and extends outwardly through the slot and away from the tube. the grip is movable along the slot to move the internal end toward or away from the second end of the tube.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
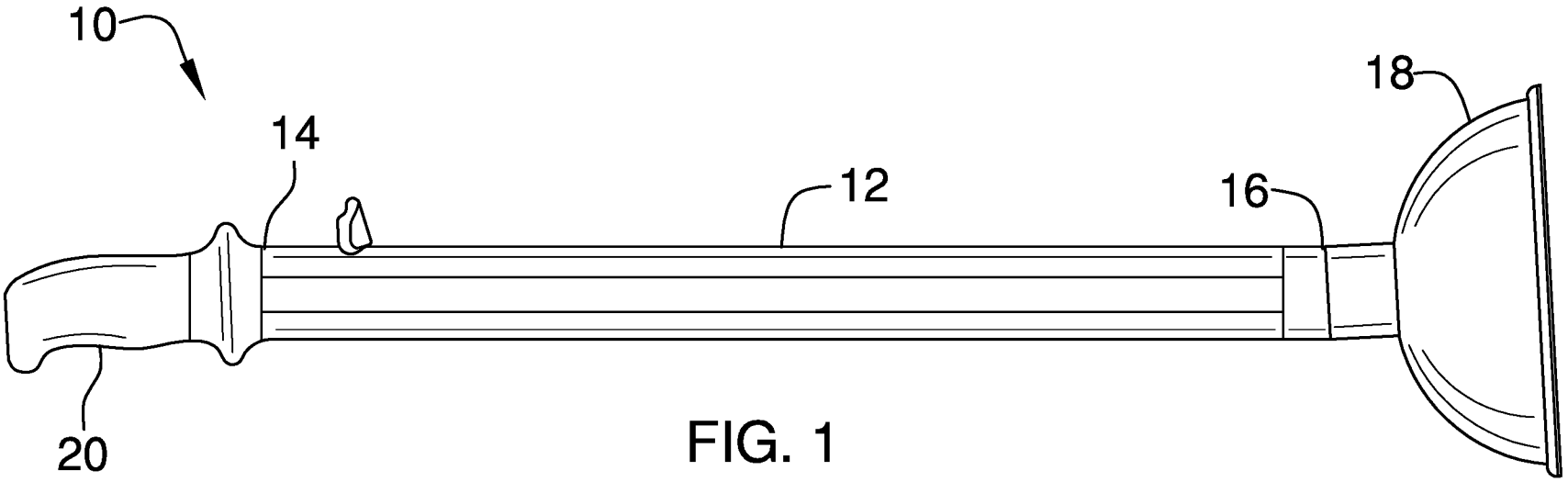
FIG. 1 is a side view of a toilet plunger and waste fracturing assembly according to an embodiment of the disclosure.
Figure 2:
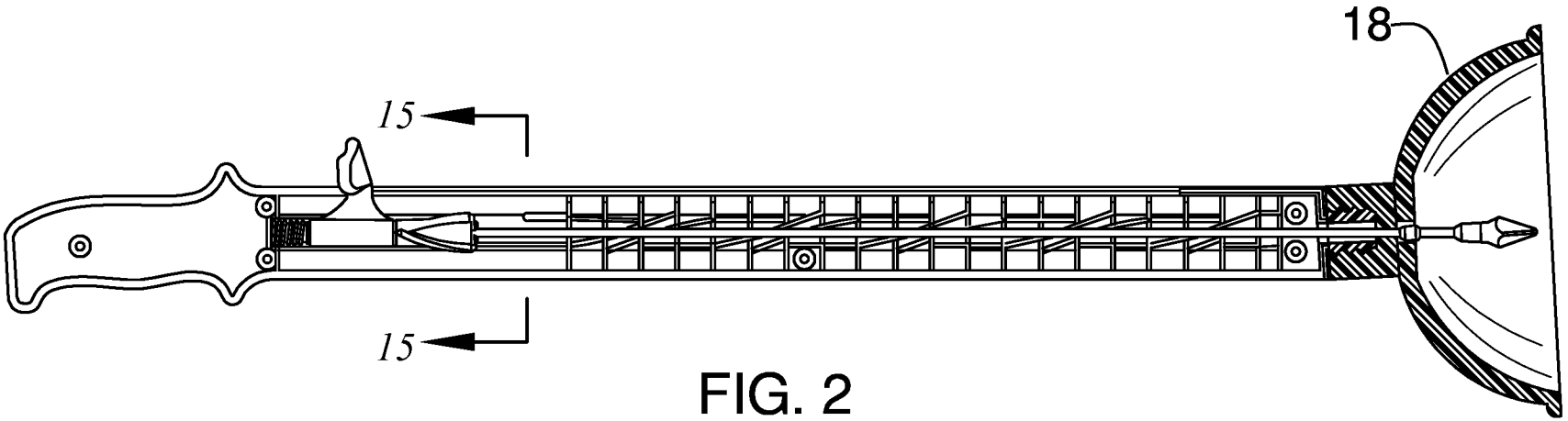
FIG. 2 is a side cross-sectional view of an embodiment of the disclosure.
Figure 3:
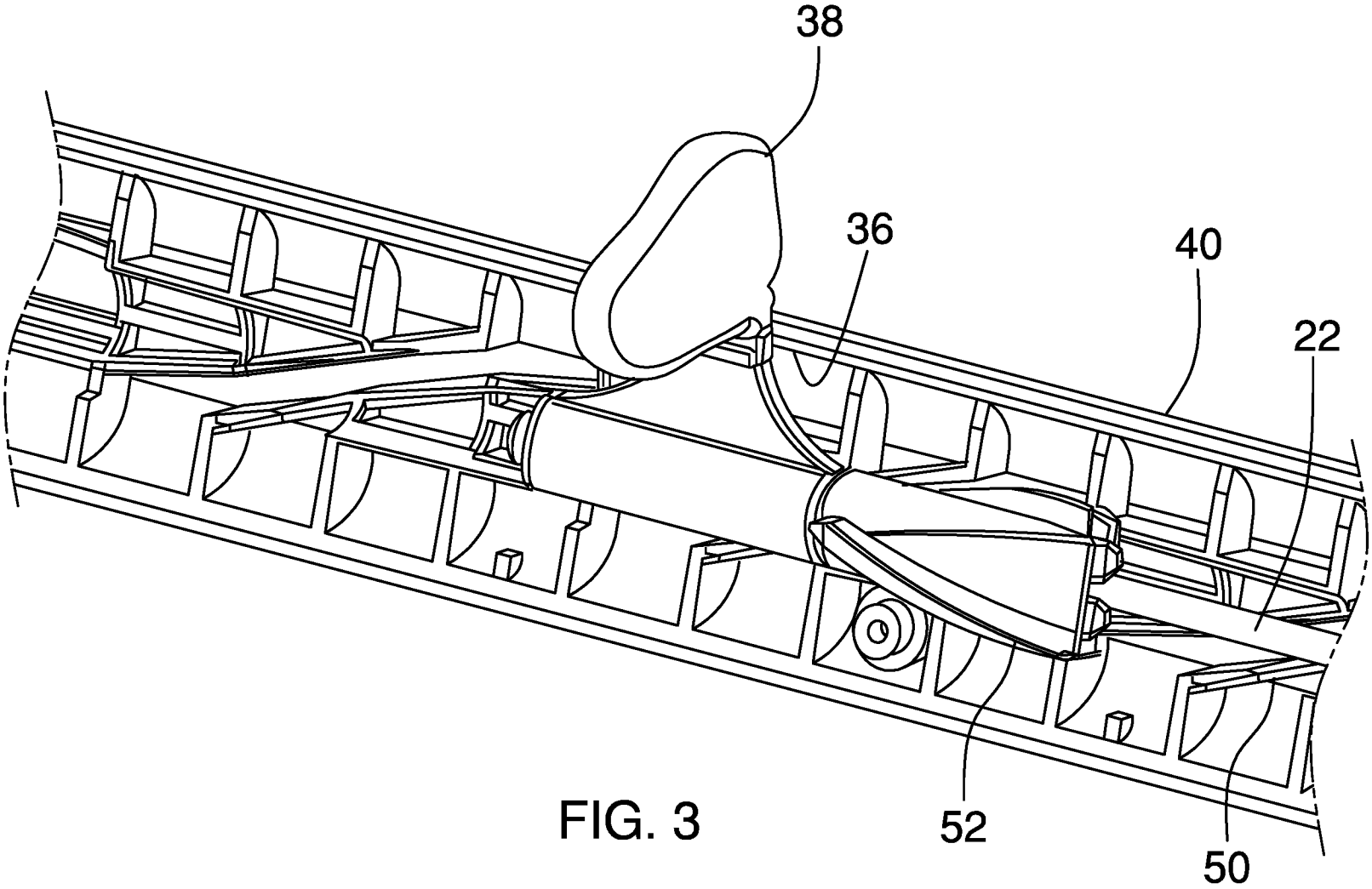
FIG. 3 is a perspective cross-sectional view of an embodiment of the disclosure.

With reference now to the drawings, and in particular to FIGS. 1 through 17 thereof, a new toilet clog clearing device embodying the principles and concepts of an embodiment of the disclosure and generally designated by the reference numeral 10 will be described.

As best illustrated in FIGS. 1 through 17, the toilet plunger and waste fracturing assembly 10 generally comprises a tube 12 that is elongated and has a first end 14 and a second end 16. FIGS. 2-5 and 8 depict a side view of ½ of the tube which may be provided in two halves that are joined together to form the tube 12 and to facilitate molding of the tube 12 during construction thereof. The tube 12 has a longitudinal axis extending between the first 14 and second 16 ends and the tube 12 may have a length generally between 18.0 inches and 36.0 inches. A cup 18 is attached to the second end 16 and is comprised of a resiliently flexible material such as an elastomeric material. The cup 18 is configured to be used to force fluid down a toilet drain and thus functions a conventional toilet plunger. A handle 20 may be attached to the first end 14 of the tube 12 to enhance gripping of the assembly 10.

A rod 22 is positioned in the tube 12 and extends outwardly of the second end 14 and through an aperture 24 in the cup 18. The rod 22 has an interior end 26 positioned within the tube 12 and an exterior end 28 positioned outside of the tube 12. The rod 22 is elongated and is resiliently flexible. The rod 22 may be comprised of a plastic material or similar such that it generally retains a straight configuration but the material allows the rod 22 to bend through the first, and possibly second, bend of a toilet drain and air trap. The exterior end 28 comprises a spear tip 30. The spear tip 30 may be removably attached to the rod 22. This will allow alternate types of tips to be used with the assembly 10. For example, a tip comprising small hooks, such as those found on the hook portion of a hook and loop coupler, may be used for engaging, capturing and remove hair from drains. Another example would include a magnetic tip that would be used for removing magnetically active metallic objects from a drain.

A plug 32 is positioned on the rod 22 adjacent to the outer end 28. The plug 32 extends around the rod 22 and seals the aperture 24 when the rod 22 is in a retracted position with respect to the tube 12. The term "retracted position" is defined herein to mean that the rod is pulled into the tube 12 to its fullest extend possible. Additionally, an aperture seal 34 may be provided that is attached to the cup 18 and is coextensive with the aperture 24. The aperture seal 34 inhibits fluids from entering the tube 12 between the rod 22 and a perimeter edge of the aperture 24 and also clears the rod 22 of fluids and solid matter positioned on the rod 22 so that such does not enter the tube 12. The rod 22 may be equipped with fins 35 that engage the aperture seal 34 to selectively open the seal 34 in order to allow any fluid within the tube 12 to escape therefrom.

Figure 9:
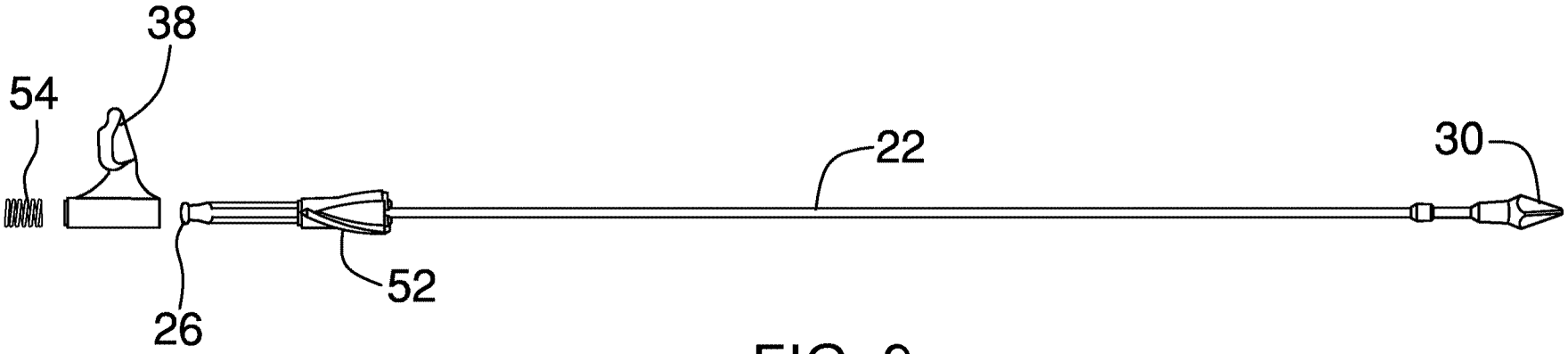
FIG. 9 is a side exploded view of a rod and the grip an embodiment of the disclosure.
Figure 10:
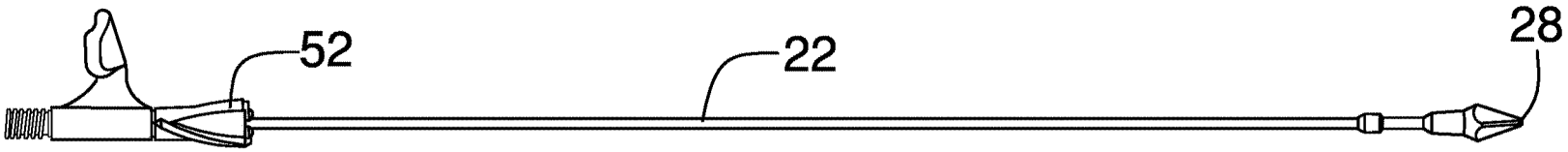
FIG. 10 is a side view of an embodiment of the disclosure.
Figure 11:
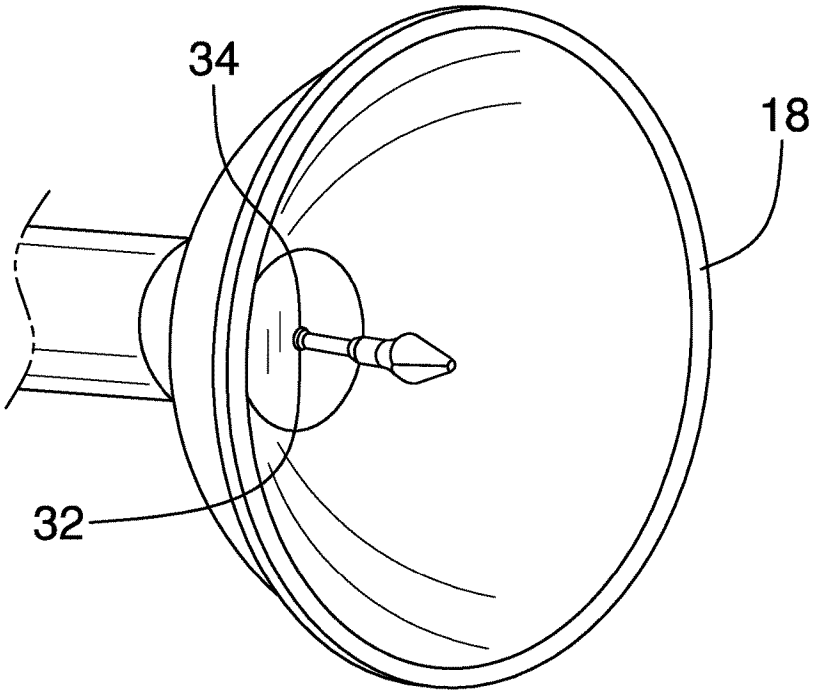
FIG. 11 is a bottom perspective view of a cup of an embodiment of the disclosure.
Figure 12:
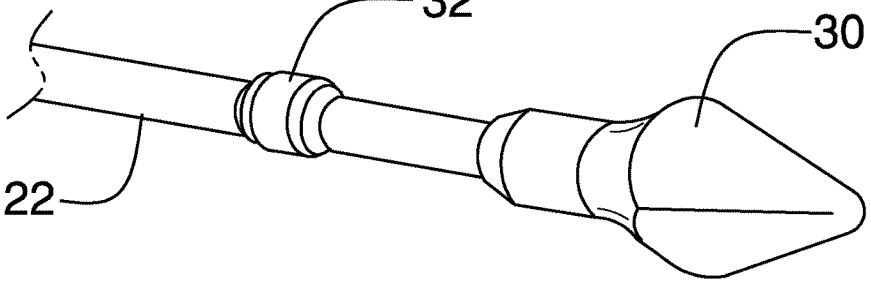
FIG. 12 is a broken perspective view of an embodiment of the disclosure.
Figure 14:
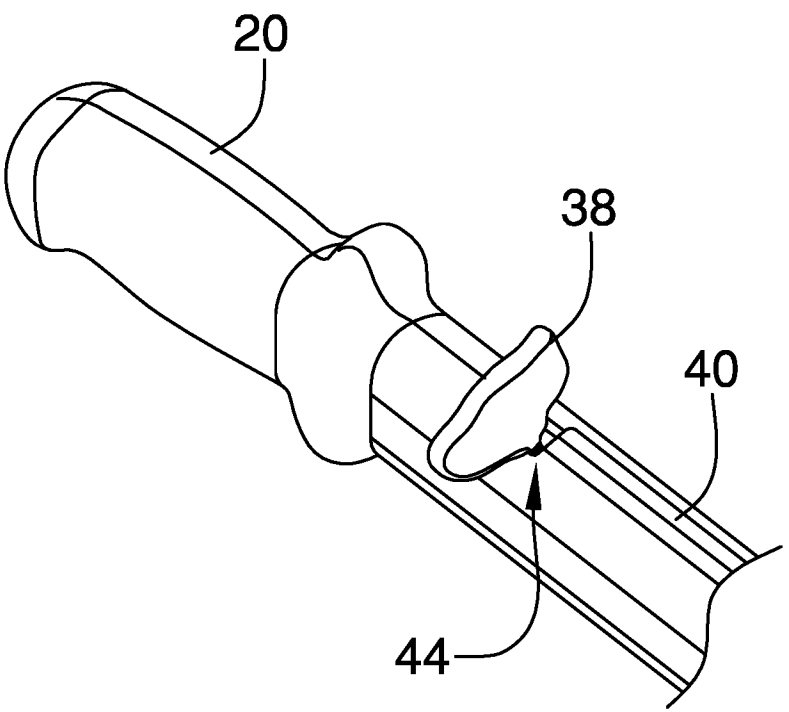
FIG. 14 is a perspective view of an embodiment of the disclosure.
Figure 13:
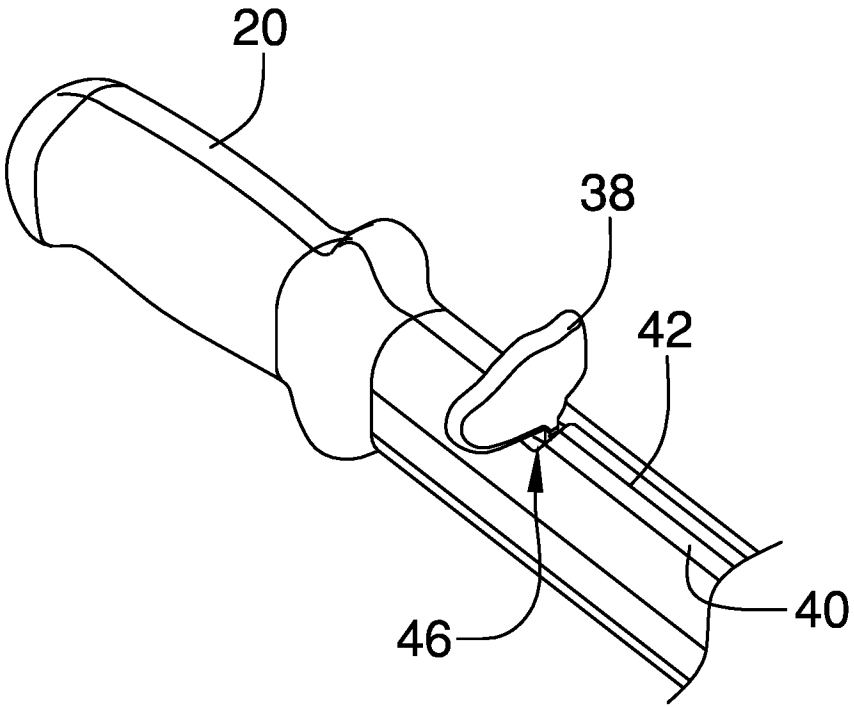
FIG. 13 is a perspective view of a handle and the grip an embodiment of the disclosure.
Figure 16:
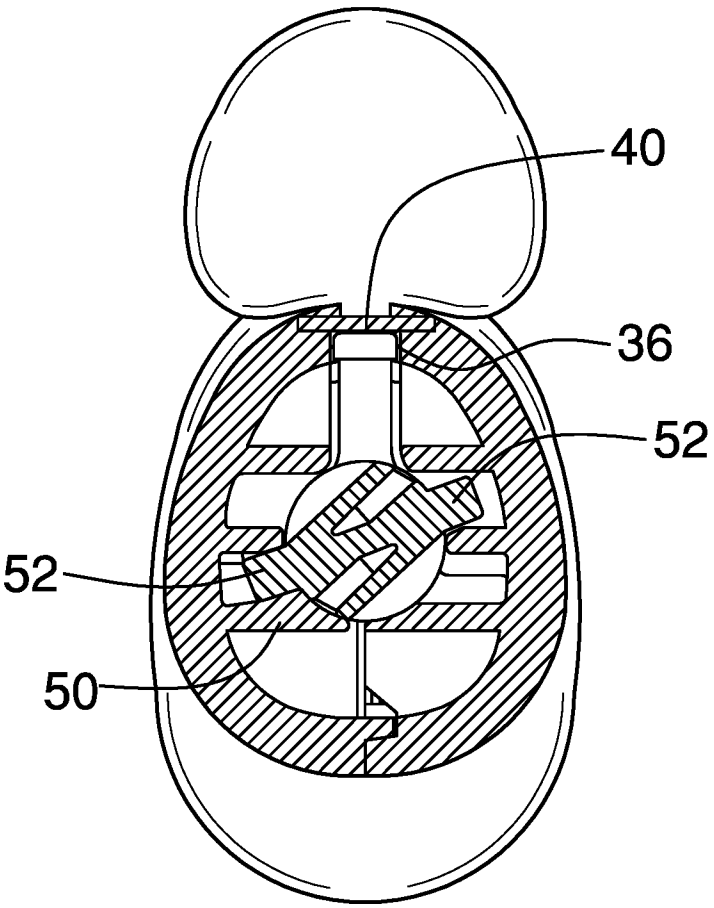
FIG. 16 is a cross-sectional view taken along line 16-16 of FIG. 8 of the disclosure.
Figure 15:
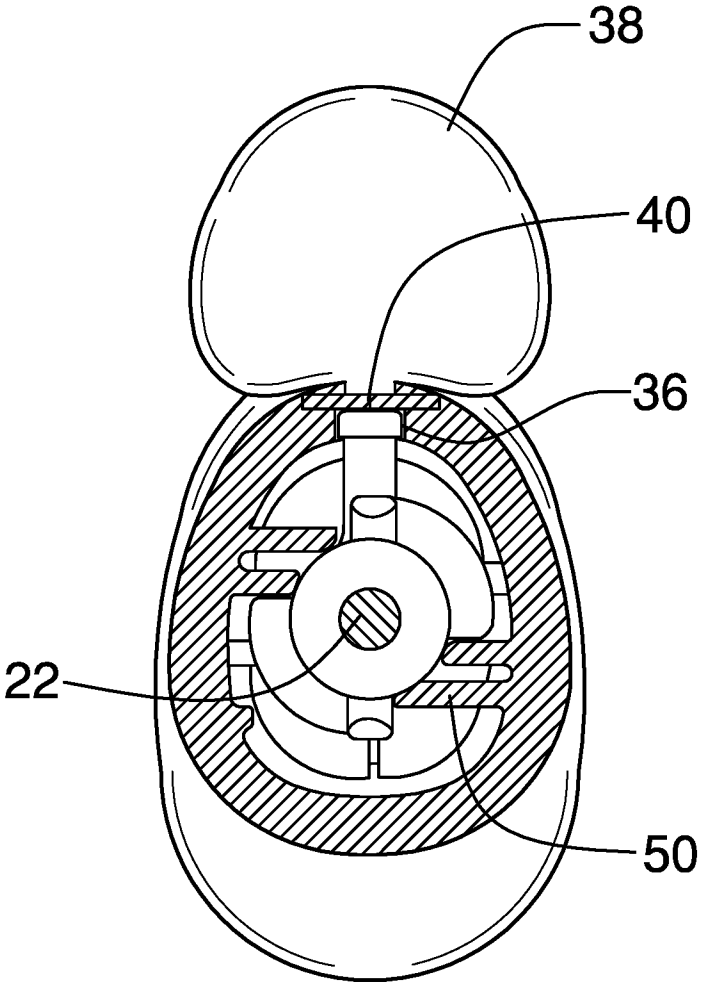
FIG. 15 is a cross-sectional view taken along line 15-15 of FIG. 2 of the disclosure.
Figure 17:
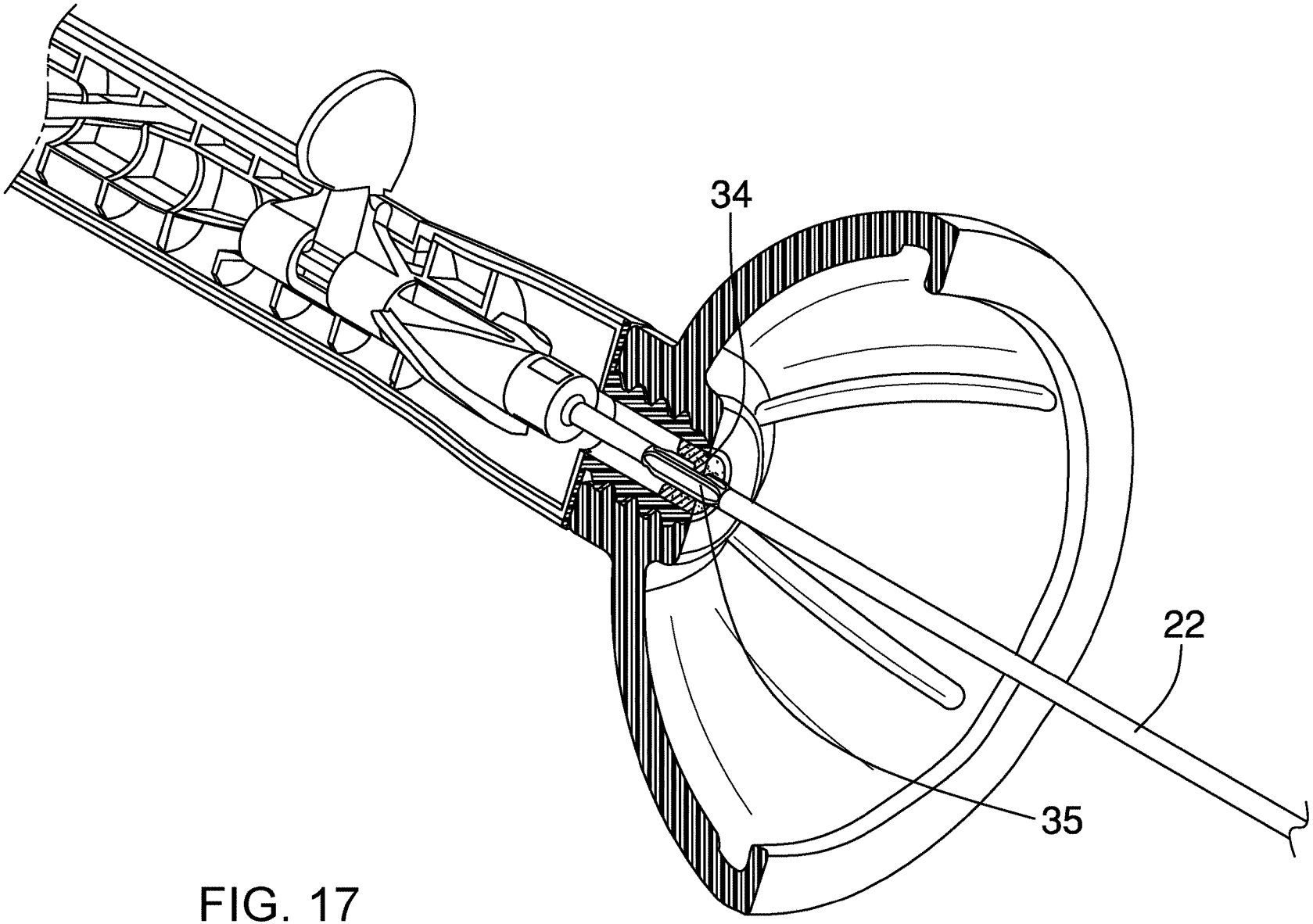

The tube 12 has a slot 36 therein that is elongated and extends through and along a perimeter wall of the tube 12. The slot 36 extends along a line that is parallel to the longitudinal axis. A grip 38 is attached to, or adjacent to, the internal end 26 of the rod 22. The grip 38 is positioned in the slot 36 and extends outwardly through the slot 36 and away from the tube 12. The grip 38 is movable along the slot 36 to move the internal end 26 toward or away from the second end 16 of the tube 12. This allows a user to use the outer end 28 to repeatedly thrust the exterior end 28 into matter clogging a toilet drain. A grip seal 40 is attached to the tube 12 and is positioned over the slot 36. The grip seal 40 may comprise an elastomeric flap, positioned over the slot 36, which has an elongated slit 42 therein. The elongated slit 42 is aligned with the slot 36 and receives the grip 38. The grip seal 40 inhibits fluid from entering the tube 12 through the slot 36. A stop 44 engages the grip 38 when the rod 22 in the retracted position so that the rod 22 does not extend beyond a terminal edge of the cup 18 as shown in FIG. 9 unless such is desired. The stop 44 may comprise a shoulder 46 that is formed in the slot 36 adjacent to the first end 14. The grip 38 is rotated outwardly of the slot 36 and positioned on the shoulder 46 to inhibit the grip 38 from moving toward the second end 16.

A helical guide 50 may be attached to an interior surface of the tube 12. As can be seen in the figures, a pair of helical guides 50 may be provided. A flange 52 is attached to the rod 22 nearer to the interior end 26 than the exterior end 28. The flange 52 is fixed to the rod 22 such that rotation of the flange 52 will cause rotation of the rod 22. The flange 52 engages the helical guide 50, or guides, so that the helical guide 50 rotates the flange 52 and the rod 22 when the interior end 26 moves toward the second end 16 of the tube 12. The flange 52 may comprise a plurality of arcuate wings as most easily viewed in FIG. 3. As shown in FIG. 9, the grip 38 and rod may comprise two pieces so that the grip 38 is rotatably coupled to the rod 22. Thus, grip 38 remains axially stationary, i.e. the grip 38 does not rotate, when the rod 22 rotates. Though the assembly 10 may be practiced without the helical guide 50, the rotating of the rod 22 facilitates the breaking up of waste.

Figure 4:
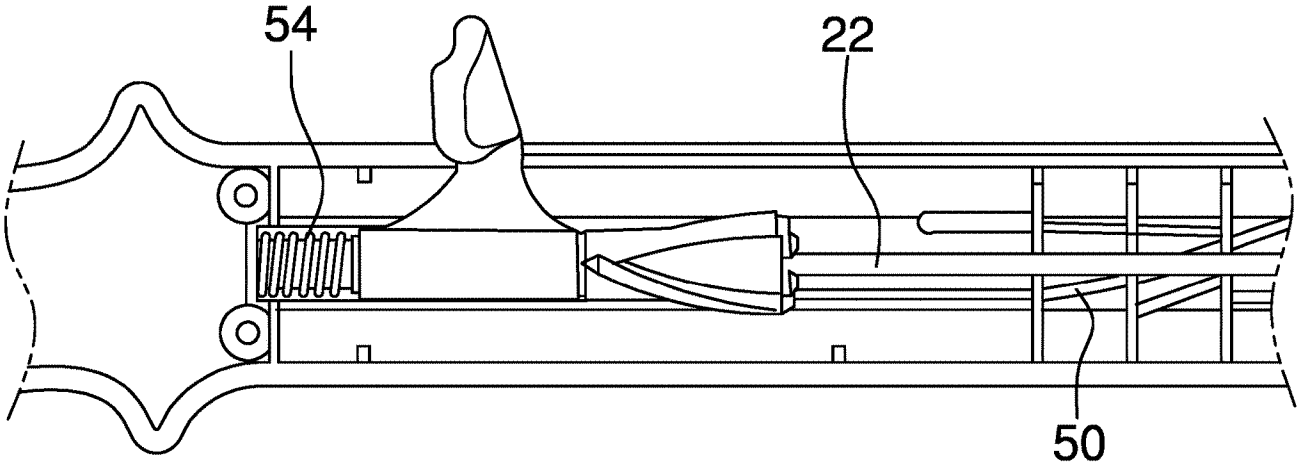
FIG. 4 is a cross-sectional view of an embodiment of the disclosure.
Figure 5:
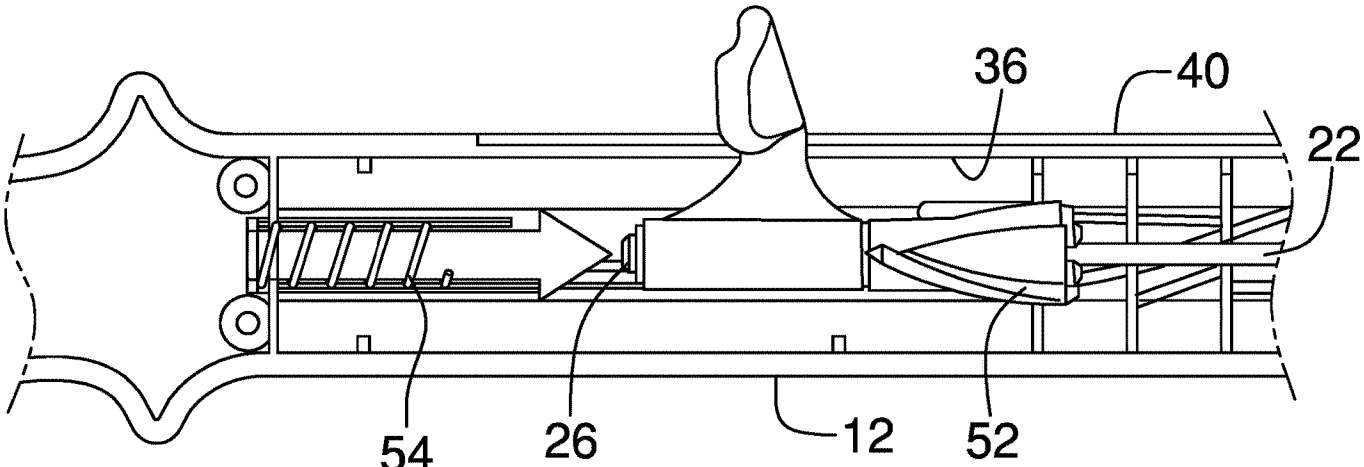
FIG. 5 is a cross-sectional view of an embodiment of the disclosure, the arrow therein depicting direction of force applied by spring 54.
Figure 6:
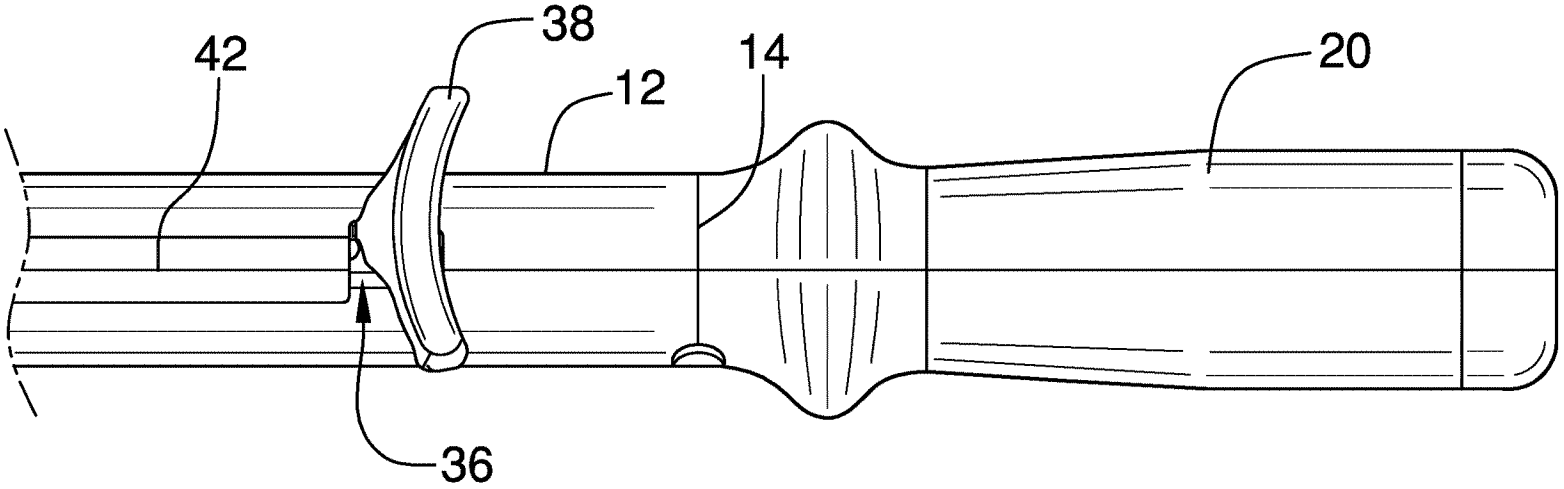
FIG. 6 is a broken top view of an embodiment of the disclosure.
Figure 7:
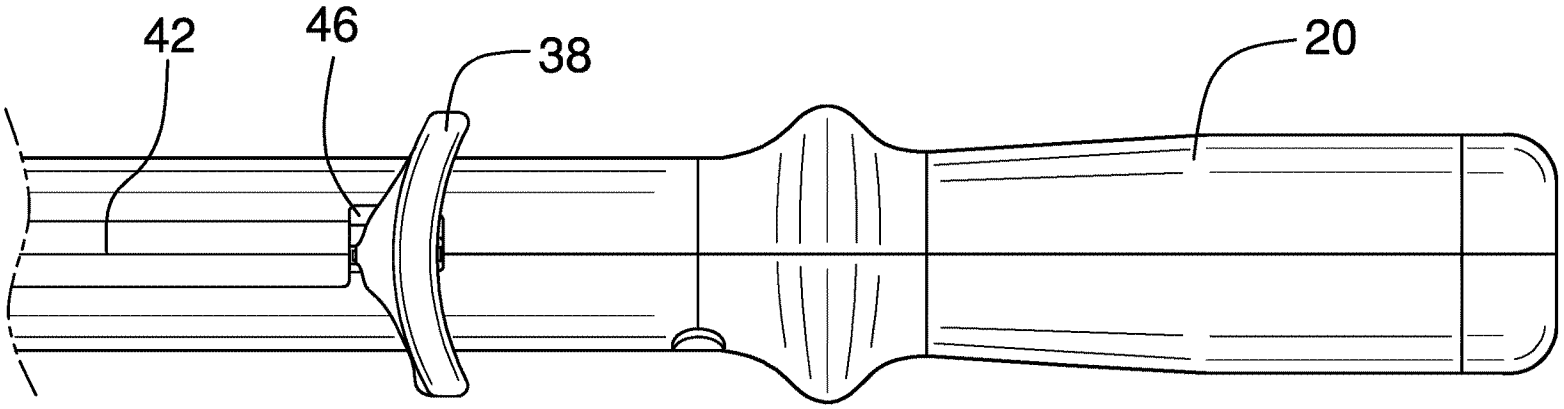
FIG. 7 is a broken top view of an embodiment of the disclosure.
Figure 8:
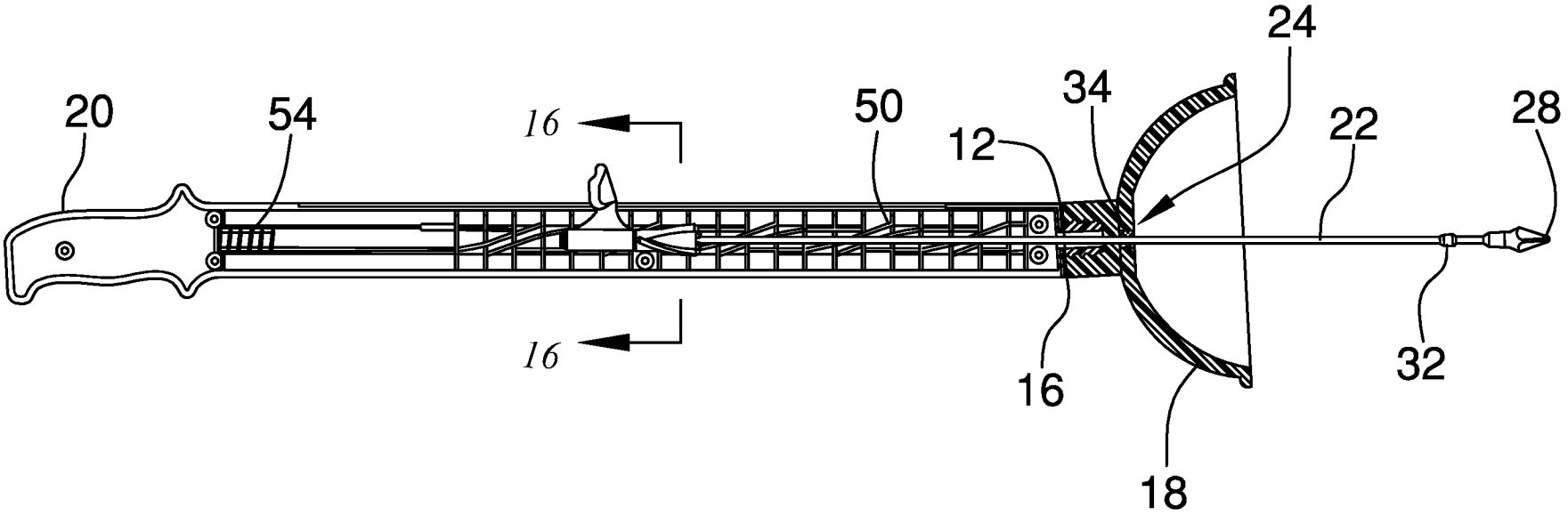
FIG. 8 is a cross-sectional view of an embodiment of the disclosure.

An actuation assembly is used to force the rod away from the first end 14 and outwardly of the second end 16. An example of such an actuation assembly, as best shown in FIGS. 4 and 5, a spring 54 may be mounted within the tube 12. The spring 54 is compressed by the grip 38 and the rod 22 when the rod 22 is in the retracted position as shown in FIG. 4. The spring 54 urges the interior end 26 of the rod 22 toward the second end 16 of the tube 12 (in the direction of the arrow in FIG. 5). This action causes a forceful exertion of water pressure when the grip 38 is released from the shoulder 46 causing the rod 22 to quickly shoot outwardly of the tube 12. This pressure helps to dislodge any matter causing a clog in the toilet drain. The spring 54 will typically not cause the rod 22 to extend to its greatest length outside of the tube 12, but will cause it to move along a portion of the tube wherein the first 1.0 inches to 6.0 inches of travel may be without the helical guide 50 such that the rod is not rotated as it is being moved by the force of the spring 54.

In use, the assembly 10 may be used as a conventional plunger using only the tube 12 and the cup 18. However, as some clogs cannot be cleared by water pressure provided by the cup alone, the assembly includes a rod 22 and spear tip 30 which may be extended from the cup 18. The spear tip 30 is used to break up the clog so that it can be cleared from the toilet drain. It should be understood that other drains may also be cleared with the assembly 10 in a similar manner.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A plunger and waste matter boring combination assembly, said assembly comprising:

a tube having a first end and a second end, said tube having a longitudinal axis extending between said first and second ends;

a cup being attached to said second end, said cup being comprised of a resiliently flexible material and being configured to be used to force fluid down a toilet drain;

a rod being positioned in said tube and extending outwardly of said second end and through an aperture in said cup, said rod having an interior end positioned within said tube and an exterior end positioned outside of said tube;

said tube having an elongated slot therein extending through and along a perimeter wall of said tube, said slot extending along a line being parallel to said longitudinal axis;

a grip being attached to said internal end of said rod, said grip being positioned in said slot and extending outwardly through said slot and away from said tube, said grip being movable along said slot to move said internal end toward or away from said second end of said tube;

a helical guide being attached to an interior surface of said tube;

a flange being attached to said rod nearer to said interior end than said exterior end, said flange engaging said guide, said helical guide rotating said flange and said rod when said interior end moves toward said second end, said grip being rotatably coupled to said rod such that said grip remains axially stationary when said rod rotates.

2. The plunger and waste matter boring combination assembly according to claim 1, wherein said rod being elongated and being resiliently flexible.

3. The plunger and waste matter boring combination assembly according to claim 2, wherein said exterior end comprises a spear tip.

4. The plunger and waste matter boring combination assembly according to claim 3, wherein said spear tip is removably attached to said rod.

5. The plunger and waste matter boring combination assembly according to claim 1, further including a plug being positioned on said rod adjacent to said outer end, said plug sealing said aperture when said rod is in a retracted position with respect to said tube.

6. The plunger and waste matter boring combination assembly according to claim 1, further including an aperture seal being attached to said cup and being coextensive with said aperture, said aperture seal inhibiting fluids from entering said tube between said rod and a perimeter edge of said aperture.

7. A plunger and waste matter boring combination assembly, said assembly comprising:

a tube having a first end and a second end, said tube having a longitudinal axis extending between said first and second ends;

a cup being attached to said second end, said cup being comprised of a resiliently flexible material and being configured to be used to force fluid down a toilet drain;

a rod being positioned in said tube and extending outwardly of said second end and through an aperture in said cup, said rod having an interior end positioned within said tube and an exterior end positioned outside of said tube;

said tube having an elongated slot therein extending through and along a perimeter wall of said tube, said slot extending along a line being parallel to said longitudinal axis;

a grip being attached to said internal end of said rod, said grip being positioned in said slot and extending outwardly through said slot and away from said tube, said grip being movable along said slot to move said internal end toward or away from said second end of said tube; and a grip seal being attached to said tube and being positioned over said slot, said grip seal having an elongated slit therein, said elongated slit being aligned with said slot and receiving said grip, said grip seal inhibiting fluid from entering said tube through said slot.

8. The plunger and waste matter boring combination assembly according to claim 1, further including a stop engaging said grip when said rod in a retracted position, said stop comprising a shoulder being formed in said slot adjacent to said first end, said grip being positioned on said shoulder to inhibit said grip from moving toward said second end.

9. The plunger and waste matter boring combination assembly according to claim 1, further including a spring being mounted within said tube, said spring being compressed by said grip and said rod when said rod is in a retracted position, said spring urging said interior end of said rod toward said second end of said tube.

10. The plunger and waste matter boring combination assembly according to claim 9, further including a stop engaging said grip when said rod in said retracted position, said stop comprising a shoulder being formed in said slot adjacent to said first end, said grip being positioned on said shoulder to inhibit said grip from moving toward said second end.

11. The plunger and waste matter boring combination assembly according to claim 9, further including a grip seal being attached to said tube and being positioned over said slot, said grip seal having an elongated slit therein, said elongated slit being aligned with said slot and receiving said grip, said grip seal inhibiting fluid from entering said tube through said slot.

12. The plunger and waste matter boring combination assembly according to claim 1, further including a handle being attached to said first end of said tube.

13. A plunger and waste matter boring combination assembly, said assembly comprising:

a tube having a first end and a second end, said tube having a longitudinal axis extending between said first and second ends;

a cup being attached to said second end, said cup being comprised of a resiliently flexible material and being configured to be used to force fluid down a toilet drain;

a rod being positioned in said tube and extending outwardly of said second end and through an aperture in said cup, said rod having an interior end positioned within said tube and an exterior end positioned outside of said tube, said rod being elongated and being resiliently flexible, said exterior end comprising a spear tip, said spear tip being removably attached to said rod;

a plug being positioned on said rod adjacent to said outer end, said plug sealing said aperture when said rod is in a retracted position with respect to said tube;

an aperture seal being attached to said cup and being coextensive with said aperture, said aperture seal inhibiting fluids from entering said tube between said rod and a perimeter edge of said aperture;

said tube having an elongated slot therein extending through and along a perimeter wall of said tube, said slot extending along a line being parallel to said longitudinal axis;

a grip being attached to said internal end of said rod, said grip being positioned in said slot and extending outwardly through said slot and away from said tube, said grip being movable along said slot to move said internal end toward or away from said second end of said tube;

a grip seal being attached to said tube and being positioned over said slot, said grip seal having an elongated slit therein, said elongated slit being aligned with said slot and receiving said grip, said grip seal inhibiting fluid from entering said tube through said slot;

a stop engaging said grip when said rod in said retracted position, said stop comprising a shoulder being formed in said slot adjacent to said first end, said grip being positioned on said shoulder to inhibit said grip from moving toward said second end;

a helical guide being attached to an interior surface of said tube;

a flange being attached to said rod nearer to said interior end than said exterior end, said flange engaging said guide, said helical guide rotating said flange and said rod when said interior end moves toward said second end, said grip being rotatably coupled to said rod such that said grip remains axially stationary when said rod rotates;

a spring being mounted within said tube, said spring being compressed by said grip and said rod when said rod is in said retracted position, said spring urging said interior end of said rod toward said second end of said tube; and a handle being attached to said first end of said tube.

* * * * *